US009935394B2

(12) United States Patent
Williams

(10) Patent No.: US 9,935,394 B2
(45) Date of Patent: Apr. 3, 2018

(54) ELECTRICAL CONNECTOR

(71) Applicant: Connec Limited, Rushcutters Bay, New South Wales (AU)

(72) Inventor: Stephen Williams, Rushcutters Bay (AU)

(73) Assignee: Connec Limited, Rushcutters, New South Wales (AU)

( * ) Notice: Subject to any disclaimer, the term of this patent is extended or adjusted under 35 U.S.C. 154(b) by 0 days.

(21) Appl. No.: 15/320,723

(22) PCT Filed: Nov. 27, 2014

(86) PCT No.: PCT/AU2014/001076
§ 371 (c)(1),
(2) Date: Dec. 20, 2016

(87) PCT Pub. No.: WO2016/011474
PCT Pub. Date: Jan. 28, 2016

(65) Prior Publication Data

US 2017/0141509 A1 May 18, 2017

(30) Foreign Application Priority Data

Jul. 24, 2014 (AU) ..... 2014902875

(51) Int. Cl.
*H01R 13/52* (2006.01)
*H01R 13/527* (2006.01)
(Continued)

(52) U.S. Cl.
CPC ..... *H01R 13/527* (2013.01); *H01B 9/006* (2013.01); *H01R 13/502* (2013.01);
(Continued)

(58) Field of Classification Search
CPC .... H01R 43/18; H01R 13/655; H01R 13/533; H01R 13/502; H01R 13/527; H01B 9/006
(Continued)

(56) References Cited

U.S. PATENT DOCUMENTS 2,547,394 A 4/1951 Ibrell
3,328,744 A 6/1967 Fiske
(Continued)

FOREIGN PATENT DOCUMENTS

CN 101 728 705 6/2010
DE 14 90 183 A1 1/1969
(Continued)

OTHER PUBLICATIONS

International Search Report dated Dec. 24, 2014 in International Application PCT/AU2014/001076 filed Nov. 27, 2014.
(Continued)

*Primary Examiner* — Abdullah Riyami
*Assistant Examiner* — Nelson R Burgos-Guntin
(74) *Attorney, Agent, or Firm* — Knobbe, Martens, Olson & Bear, LLP

(57) ABSTRACT

An electrical connection component for a machine cable is described. The electrical connection component is suitable for transmission of power with voltage levels greater than or equal to 1 kV and comprises at least one electrical conductor arranged for electrically coupling with a further electrical conductor of another electrical connection component. The electrical connection component comprises a housing having an internal region, and having a machine cable end, a connection end and a plurality of electrically insulating components positioned within the housing, at least one of the electrically insulating components being arranged so as to form-fit with a further one of the electrically insulating components. A portion of the internal region of the housing
(Continued)

that is located at the connection end of the housing, and that would not otherwise be filled with the at least one electrical conductor and/or an associated flame path, is filled by the electrically insulating components.

15 Claims, 7 Drawing Sheets

(51) Int. Cl.
*H01R 13/533* (2006.01)
*H01R 13/502* (2006.01)
*H01R 13/655* (2006.01)
*H01R 43/18* (2006.01)
*H01B 9/00* (2006.01)

(52) U.S. Cl.
CPC ..... *H01R 13/533* (2013.01); *H01R 13/655* (2013.01); *H01R 43/18* (2013.01)

(58) Field of Classification Search
USPC ..... 439/170, 173, 446, 905, 576
See application file for complete search history.

(56) References Cited

U.S. PATENT DOCUMENTS 3,382,475 A * 5/1968 Sigmund ..... H01R 31/00 439/170
3,555,487 A * 1/1971 Jones ..... H01J 29/925 439/199
3,945,708 A 3/1976 Griffin
4,142,770 A * 3/1979 Butler, Jr. ..... H01R 13/523 439/140
4,417,736 A 11/1983 Herrmann, Jr.
4,420,202 A * 12/1983 Atakkaan ..... H01R 13/53 439/278
4,790,767 A 12/1988 Sturdevan et al.
5,130,495 A 7/1992 Thompson
5,154,638 A * 10/1992 Sireul ..... H05G 1/08 439/611
5,503,569 A 4/1996 Huss, Jr. et al.
5,580,266 A 12/1996 Shelly
5,626,486 A 5/1997 Shelly et al.
5,785,543 A 7/1998 Dietrich
5,801,465 A 9/1998 Yamada
6,485,326 B1 11/2002 Trainor et al.
6,517,368 B2 2/2003 Hara et al.
6,641,421 B1 11/2003 Leavitt et al.
7,229,303 B2 6/2007 Vermoesen et al.
7,419,397 B2 9/2008 Casperson et al.
7,485,806 B1 2/2009 Gretz
7,632,120 B2 12/2009 Hughes et al.
7,690,936 B1 4/2010 Snekkevik et al.
8,460,015 B2 * 6/2013 Deno ..... H01R 9/0518 174/78
9,620,903 B2 4/2017 Joo et al.
2008/0139030 A1 * 6/2008 Milo ..... B60T 17/04 439/277
2012/0034825 A1 2/2012 Yuan
2012/0100737 A1 * 4/2012 Frey ..... H01R 13/523 439/271
2013/0095700 A1 4/2013 Shultz
2013/0102176 A1 4/2013 Kazubowski
2013/0130525 A1 5/2013 Hachadorian
2013/0189865 A1 * 7/2013 Zaiser ..... H01R 13/52 439/190
2014/0106616 A1 4/2014 DeVries et al.
2014/0141658 A1 * 5/2014 Bazenas ..... H01R 13/111 439/730
2014/0273599 A1 * 9/2014 O'Sullivan ..... H01R 13/62 439/370
2015/0104964 A1 * 4/2015 McIntosh ..... H01R 13/521 439/271
2016/0126641 A1 * 5/2016 Lewin ..... H01R 4/20 439/86
2016/0172777 A1 6/2016 Bellet

FOREIGN PATENT DOCUMENTS

FR 2 979 489 A1 3/2013
WO WO 91/15039 A1 10/1991
WO WO 01/65643 A1 9/2001
WO WO 02/23679 A1 3/2002

OTHER PUBLICATIONS

International Search Report dated Dec. 24, 2014 in International Application No. PCT/AU2014/001077 filed Nov. 27, 2014.
International Search Report dated Dec. 24, 2014 in International Application No. PCT/AU2014/001082 filed Nov. 27, 2014.
International Search Report dated Feb. 27, 2015 in International Application No. PCT/AU2014/001083 filed Nov. 27, 2014.
Supplementary European Search Report dated May 26, 2017 in EP Application No. 14898109.5, filed Nov. 27, 2014, in 8 pages.
Extended European search report dated May 26, 2017, received in corresponding application EP14898131.9, filed Nov. 27, 2014.

* cited by examiner

ELECTRICAL CONNECTOR

FIELD OF THE INVENTION

The present invention relates to an electrical connector used in high power applications. In particular the present invention relates to a connector suitable for use in demanding environments such as the petroleum or mining industry.

BACKGROUND OF THE INVENTION

Reliable electrical connections are crucial in high power applications, such as powering of heavy electrical machinery often used in the mining or petroleum industry, or connection of power transportation lines. In these applications the electrical cables transmit high currents at voltages of one or more kV.

Typical electrical connectors used in the art have a plurality of pins or sockets, each being connected to a respective core of an electrical cable. Depending on the specific application, the connectors must comply with specific requirements or standards. The compliance of the connectors with the relevant standards is examined by a certifying body.

The certification of a connector for a specific application generally ensures that the connector meets basic safety requirements. While known certified connectors are now relatively safe to operate, they still have a number of disadvantages. For example, although high power connectors used in the tunnelling, mining or petroleum industries typically need to comply with strict requirements including requirements related to explosions, it may be advantageous to provide a high power connector that further reduces a risk, or the effect of, an explosion or similar.

SUMMARY OF THE INVENTION

In accordance with a first aspect of the present invention, there is provided an electrical connection component for a machine cable, the electrical connection component being suitable for transmission of power with voltage levels greater than or equal to 1 kV, the electrical connection component comprising:

- at least one electrical conductor being arranged for electrically coupling with a further electrical conductor of another electrical connection component;
- a housing having an internal region, and having a machine cable end and a connection end; and
- a plurality of electrically insulating components positioned within the housing, at least one of the electrically insulating components being arranged so as to form-fit with a further one of the electrically insulating components;
- wherein a portion of the internal region of the housing that is located at the connection end of the housing, and that would not otherwise be filled with the at least one electrical conductor and/or an associated flame path, is filled by the electrically insulating components.

The electrically insulating components may fill 10% or less, 20% or less, 30% or less, 40% or less, 50% or less, 60% or less, 70% or less, 80% or less, 90% or less, or 100% or less of the internal region of the housing measuring from the connection end that would not otherwise be filled with the at least one electrical conductor and/or an associated flame path.

In a specific embodiment, the insulating components fill more than 70%, 80% or 90% of the internal volume of an internal portion of the housing. The internal portion may fill more than 90%, 80% 70%, 60%, 50% 40%, 30% or 20% of the internal volume of the housing.

It will be appreciated that the at least one electrical conductor will typically comprise an electrical conductor portion that is electrically couplable to a core of the machine cable, and an electrical contact portion that is electrically couplable to a respective electrical contact portion of the electrical conductor of the electrical connector.

The flame path referred to above may be arranged adjacent to the electrical conductor. The flame path facilitates minimising the risk of explosion inside the electrical connection component. The flame path is sufficiently narrow to control the amount of energy that can be generated by an explosion spreading to other areas of the connector.

Filling a portion of the internal region of the housing with the electrically insulating components may be advantageous in reducing an amount of air within the housing. Reducing the amount of air within the housing may reduce a risk, or the effect, of an explosion.

The plurality of electrically insulating components may be arranged such that the at least one conductor penetrates through each of the electrically insulating components.

The plurality of electrically insulating components may be arranged such that they fit within the housing in a predefined orientation or set of orientations. For example, a first electrically insulating component may be shaped so as to fit with a second electrically insulating component in a predefined orientation. For example, the first electrically insulating component may have a protrusion having a particular shape, with the second insulating component having a correspondingly shaped recess for receiving the protrusion of the first electrically shaped recess wherein, when the first insulating component is received in the second insulating component, the first and second insulating components have a predefined orientation with respect to one another.

Further, an electrically insulating component may be arranged so as to receive a plurality of other electrically insulating components, wherein at least one of the electrically insulating components surrounds at least a portion of the at least one conductor, the at least one conductor penetrating therethrough.

The electrically insulating components may comprise a high density polymeric material, preferably being void free. It will be appreciated that one or more of the electrically insulating components may comprise a different polymeric material than one or more other of the electrically insulating components.

At least one of the electrically insulating components may be arranged to form-fit with at least a portion of the housing.

Each electrically insulating component may be arranged so as to form-fit with a further electrically insulating component.

At least one of the electrically insulating components may comprise a passage for receiving a further electrically insulating component therewithin. At least a portion of the passage may be shaped such that the further electrically insulating component fits within the passage in a predefined orientation. Such an arrangement may be advantageous in that the further electrically insulating component, which may house the at least one electrical conductor, is not twisted or otherwise moved in an undesired manner, which may facilitate preventing damage being caused to the electrical conductor.

In one embodiment, the electrical connection component comprises a first electrically insulating component that form-fits with a second electrically insulating component, the first electrically insulating component being arranged at the connection end of the housing, the second electrically insulating component being arranged between the first electrically insulating component and the machine cable end of the housing. The first and second electrically insulating components may be arranged to receive at least one third electrically insulating component through at least a portion of each of the first and second electrically insulating components. In one embodiment, the first and second electrically insulating components comprise respective passages that are aligned so as to receive the third electrically insulating component therethrough. The respective passages of the first and second electrically insulating components, and the at least one third electrically insulating component, may be arranged such that the at least one third electrically insulating component form-fits with the first and second electrically insulating components.

The at least one third electrically insulating component may comprise a flange having a particular shape, the first or the second electrically insulating component comprising a recess having a shape corresponding to that of the flange of the third electrically insulating component such that the third electrically insulating component can only be arranged through the first and second electrically insulating components in one orientation.

In one embodiment, the at least one third electrically insulating component comprises a tube that is arranged for receiving the at least one electrical conductor, the tube comprising a first material comprising an insulating material, the first material surrounding a length of the at least one electrical conductor that has been received by the tube, and a second material comprising a conductive material arranged to be electrically couplable to an earth of the machine cable, the second material surrounding the first material substantially along a length of the third electrically insulating component.

The first and second electrically insulating components may be substantially cylindrically shaped.

In accordance with a second aspect of the present invention, there is provided a method of forming an electrical connection component, the electrical connection component being in accordance with the first aspect of the present invention, the method comprising the steps of:

providing the housing, the at least one electrical conductor, and the plurality of electrically insulating components; and form-fitting at least one of the electrically insulating components with a further one of the electrically insulating components within the housing such that a portion of the internal region of the housing that is located at the connection end of the housing, and that would not otherwise be filled with the at least one electrical conductor and/or an associated flame path, is filled by the electrically insulating components.

The invention will be more fully understood from the following description of specific embodiments of the invention. The description is provided with reference to the accompanying drawings.

DETAILED DESCRIPTION OF SPECIFIC EMBODIMENTS

Figure 1:
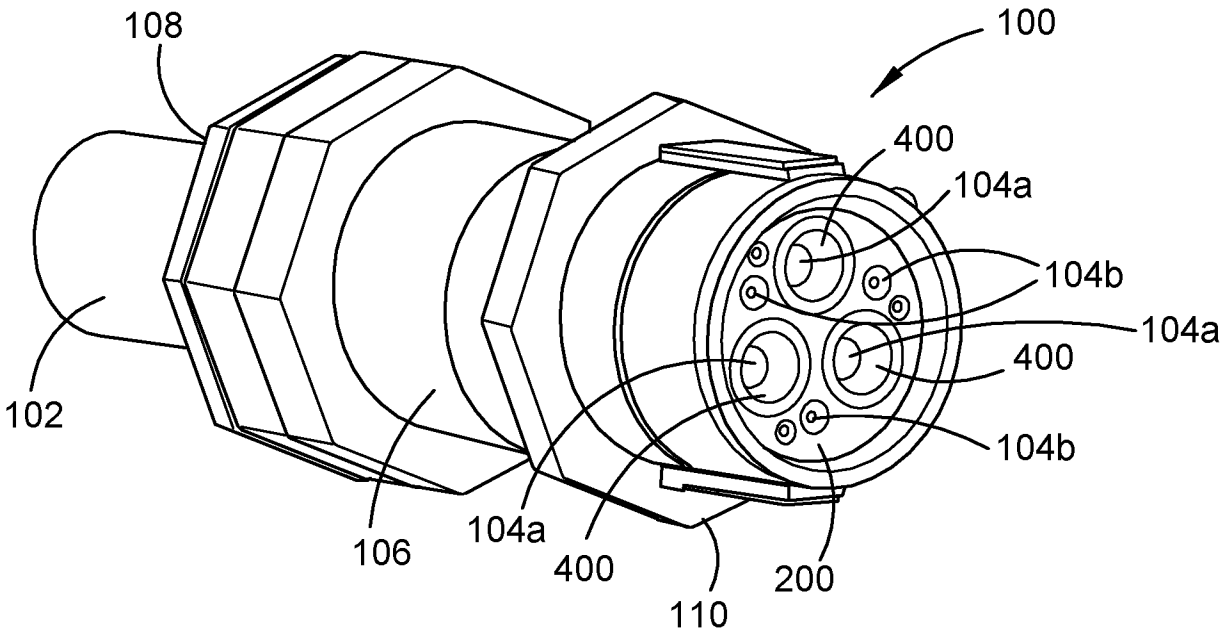
FIG. 1 is a front perspective view of an electrical connection component in accordance with an embodiment of the present invention.

Referring initially to FIG. 1, there is shown an electrical connection component 100 for a machine cable 102. In this example, the electrical connection component 100 is suitable for the delivery of power of more than 50 kW. The electrical connection component 100 comprises a plurality of electrical conductors 104*a*, 104*b* the conductors being arranged for electrically coupling with respective electrical contacts of a further electrical connector (not shown), and a housing 106 having an internal region, a machine cable end 108 and a connection end 110.

The electrical connection component 100 further comprises a plurality of electrically insulating components positioned within the housing 106. In this example, the electrical connection component 100 comprises a first electrically insulating component 200, also referred to herein as a plug cap 200 (see FIG. 2), a second electrically insulating component 300, also referred to herein as a plug body 300 (see FIG. 3), and three third electrically insulating components 400, also referred to herein as phase earth tube insulators 400 (see FIG. 4).

The electrically insulating components 200, 300, 400 are arranged to form-fit with one another, and with the housing 106, such that a portion of the internal region of the housing 106 that is located at the connection end 110 of the housing 106, and that would not otherwise be filled by the electrical conductors 104 and/or their associated flame paths, is filled by the electrically insulating components 200, 300, 400.

The portion of the internal region of the housing 106 that is located at the connection end 110 and that is filled with the electrically insulating components may account for 10% or less, 20% or less, 30% or less, 40% or less, 50% or less, 60% or less, 70% or less, 80% or less, 90% or less, or 100% or less of the length of the housing measuring from the connection end.

Filling a portion of the internal region of the housing 106 with the electrically insulating components 200, 300, 400 may be advantageous in reducing an amount of air within the housing. Reducing the amount of air within the housing may reduce a risk, or the effect, of an explosion.

The electrically insulating components typically comprise a high density polymeric material, preferably being void free. It will be appreciated that one or more of the electrically insulating components may comprise a different polymeric material than one or more other of the electrically insulating components.

Figure 2B:
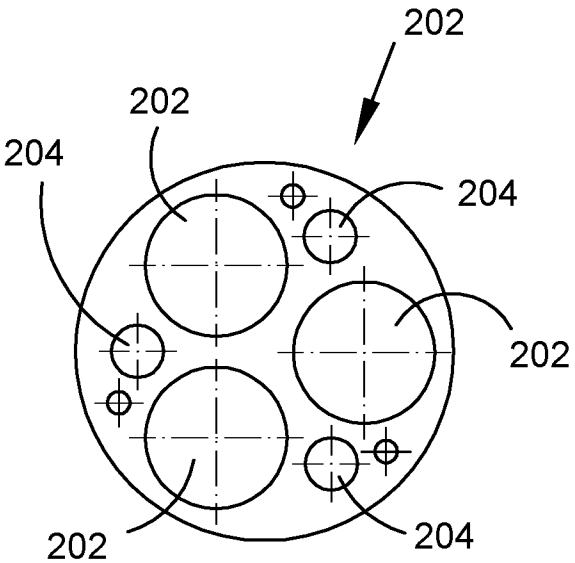
FIG. 2*b* is a top plan view of the first electrically insulating component of FIG. 2*a;*
Figure 2A:
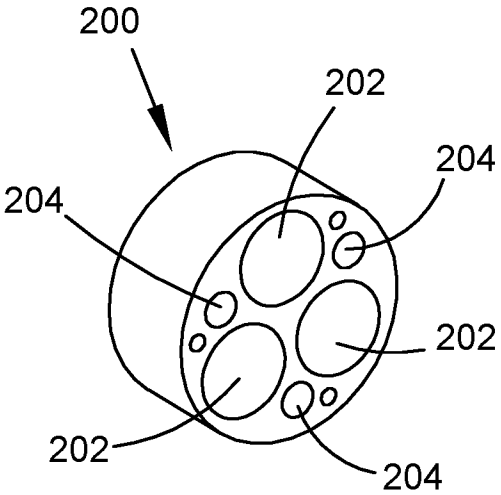
FIG. 2*a* is a front perspective view of a first electrically insulating component of the electrical connection component of FIG. 1.
Figure 3B:
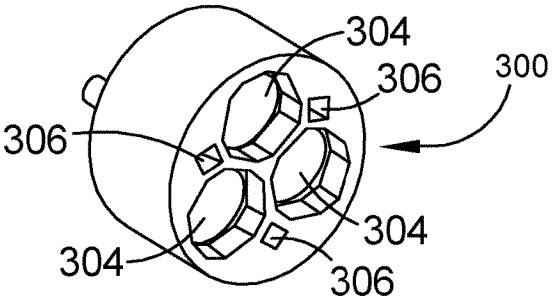
FIG. 3*b* is a reverse perspective view of the second electrically insulating component of FIG. 3*a;*
Figure 3A:
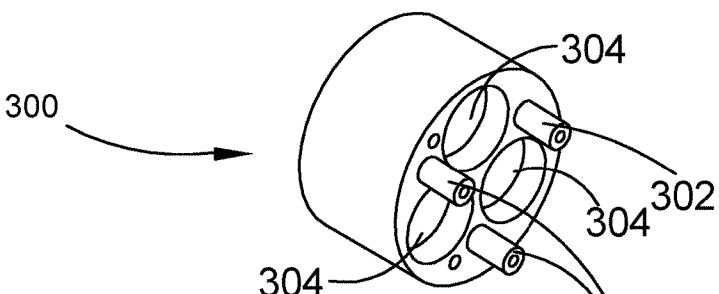
FIG. 3*a* is a front perspective view of a second electrically insulating component of the electrical connection component of FIG. 1.
Figure 3D:
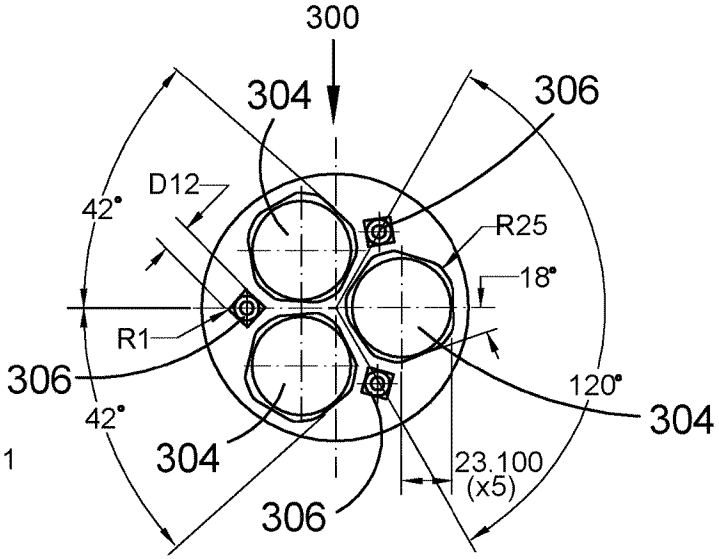
FIG. 3*d* is a bottom plan view of the second electrically insulating component of FIG. 3*a;*
Figure 3C:
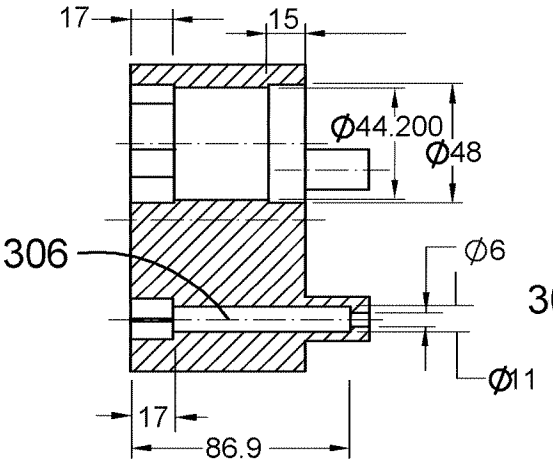
FIG. 3*c* is a cross sectional side view of the second electrically insulating component of FIG. 3*a;*

Referring to FIG. 2, the plug cap 200 is arranged at the connection end 110 of the housing 106. The plug cap 200 comprises a plurality of first passages 202 for receiving the phase earth tube insulators 400 therethrough, and a plurality of second passages 204 for receiving respective form-fitting portions 302 of the plug body 300.

Referring to FIG. 3, the plug body 300 comprises a plurality of first passages 304 that, when the plug body 300 is form-fitted with the plug cap 200, are aligned with the first passages 202 of the plug cap 200.

The form-fitting portions 302 of the plug body 300 facilitate form-fitting the plug body 300 with the plug cap 200. The plug body 300 also comprises a plurality of second passages 306 running through the plug body 300 and through a central axis of each respective form-fitting portion 302. The second passages 306 are arranged so as to align with the second passages 204 of the plug cap 200 such that the conductors 104*b*, which in this example are electrically couplable to a pilot/auxiliary circuit, can run therethrough.

Figure 4A:
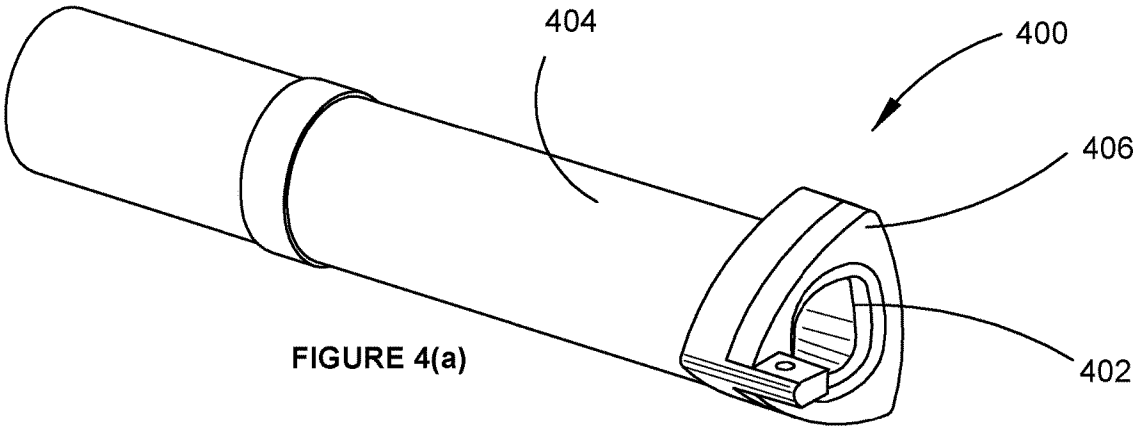
FIG. 4*a* is a rear perspective view of a third electrically insulating component of the electrical connection component of FIG. 1.
Figure 4B:
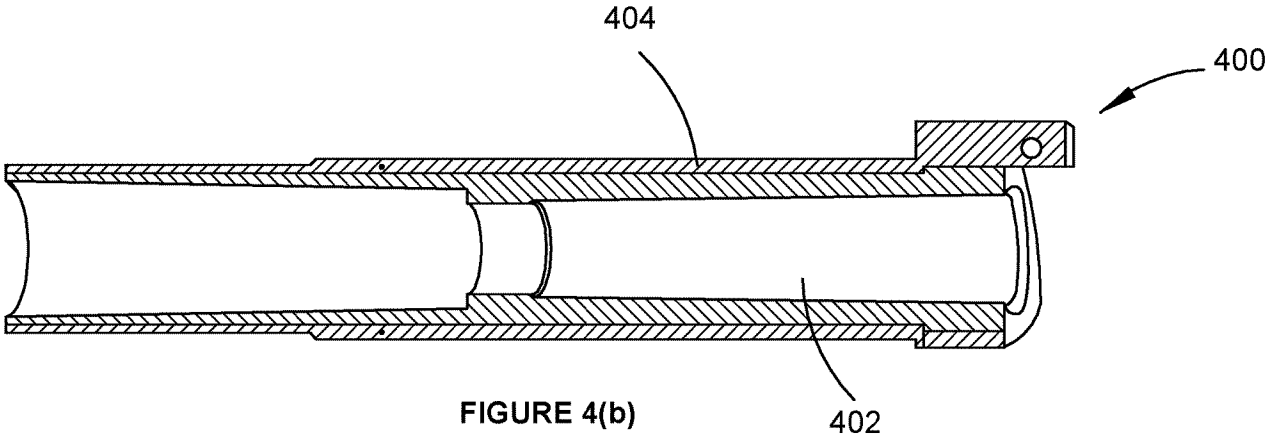
FIG. 4*b* is a cutaway side view of the third electrically insulating component of FIG. 4*a;*

An example phase earth tube insulator 400 is shown in more detail in FIG. 4. Each phase earth tube insulator 400 comprises an inner tube 402 that is arranged for receiving a respective electrical conductor 104*a*. In this example, each electrical conductor 104*a* is arranged for carrying a respective phase of a three phase power distribution network. The inner tube 402 comprises an insulating material such as one or more of the aforementioned polymer materials. The inner tube is surrounded by an outer tube 404, the outer tube 404 comprising a material such as copper that can function as an electrical earth when electrically coupled to an earth of the machine cable 102.

Each phase earth tube insulator 400 may have a flame path (not shown) to minimise the risk of explosion inside the phase earth tube insulator. The flame path is defined by an inner surface of the phase earth tube insulator which is disposed in proximity to a respective electrical pin. The space gap between the electrical pin and the inner surface of the phase earth tube insulator is sufficiently narrow to prevent excessive heating of a gas inside the phase tube and minimise the risk of an explosion.

In this example, the phase earth tube insulator 400 is received by the first passages 202, 304 of the plug cap 200 and the plug body 300. The phase earth tube insulator 400 and the first passages 202, 304 are shaped such that the phase earth tube insulator 400 form-fits with the plug cap 200 and the plug body 300.

In this example, the phase earth tube insulator 400 comprises a flanged rear portion 406 having a specific shape. The flanged rear portion 406 can be shaped so as to correspond to a shape of an opening 308 of each of the first passages 304 of the plug body 300 such that the phase earth tube insulator 400 is retained in a particular orientation when form-fitted with the plug body 300 and the plug cap 200.

Figure 5:
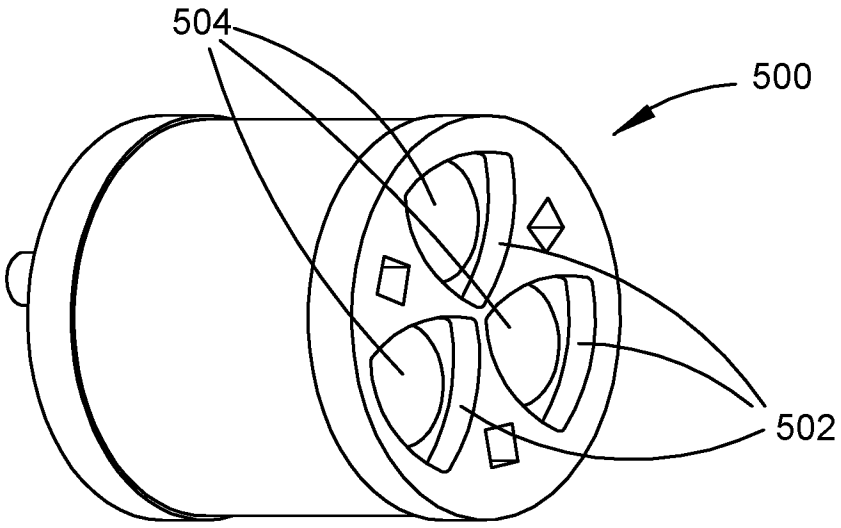
FIG. 5 is a rear perspective view of an alternative second electrically insulating component of the electrical connection component of FIG. 1.

The shape of the flanged rear portion 406 in this example corresponds to the shape of respective apertures 502 of the first passages 504 of the plug body 500 shown in FIG. 5. It will be appreciated that the respective shapes of the flanged rear portion 406 of the phase earth tube insulator 400 and the apertures 502 of the plug body 500 may be any appropriate corresponding shapes. Typically, the shape of the flanged rear portion 406 of the phase earth tube insulator 400 and the shape of the aperture 502 of the plug body 500 is such that the phase earth tube insulator 400 can be arranged in only one orientation, thereby preventing any twisting of the earth tube insulator that might otherwise cause damage to a conductor contained therein.

Figure 6:
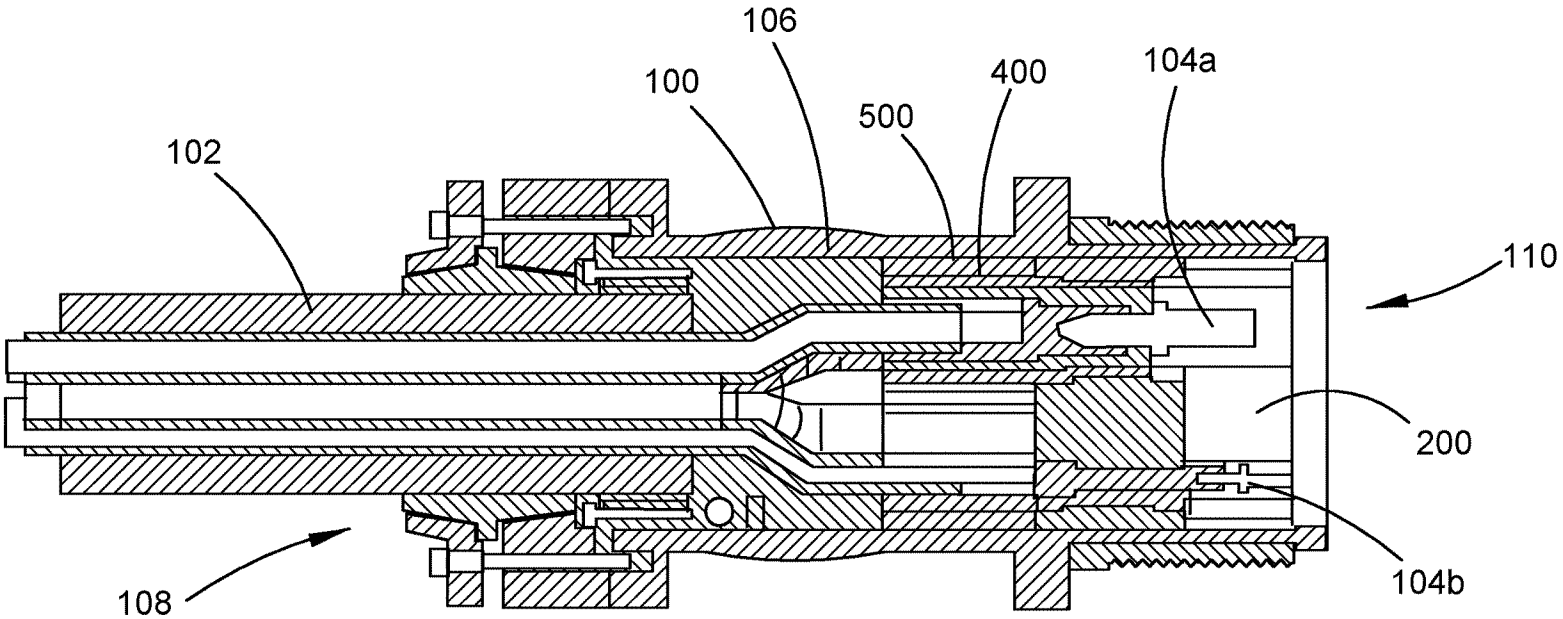
FIG. 6 is a cross sectional view of the electrical connection component of FIG. 1.

FIG. 6 shows a cross sectional view of the electrical connection component 100 comprising the plug body 500 inter-fitted with the plug cap 200 and showing the phase earth tube insulator 400 extending through the plug body 500 and the plug cap 200. The plug body 500, plug cap 200, and phase earth tube insulators 400 fill approximately 50% of the internal region of the housing measuring from the connection end 110 that would not otherwise be filled with the electrical conductors 104*a*, 104*b* and/or any associated flame paths. It will be appreciated that the plug body 500, plug cap 200, and phase earth tube insulators 400 may fill approximately 10% or less, 20% or less, 30% or less, 40% or less, 50% or less, 60% or less, 70% or less, 80% or less, 90% or less, or 100% or less of the internal region of the housing measuring from the connection end 110 that would not otherwise be filled with the electrical conductors 104*a*, 104*b* and/or any associated flame paths.

Figure 7:
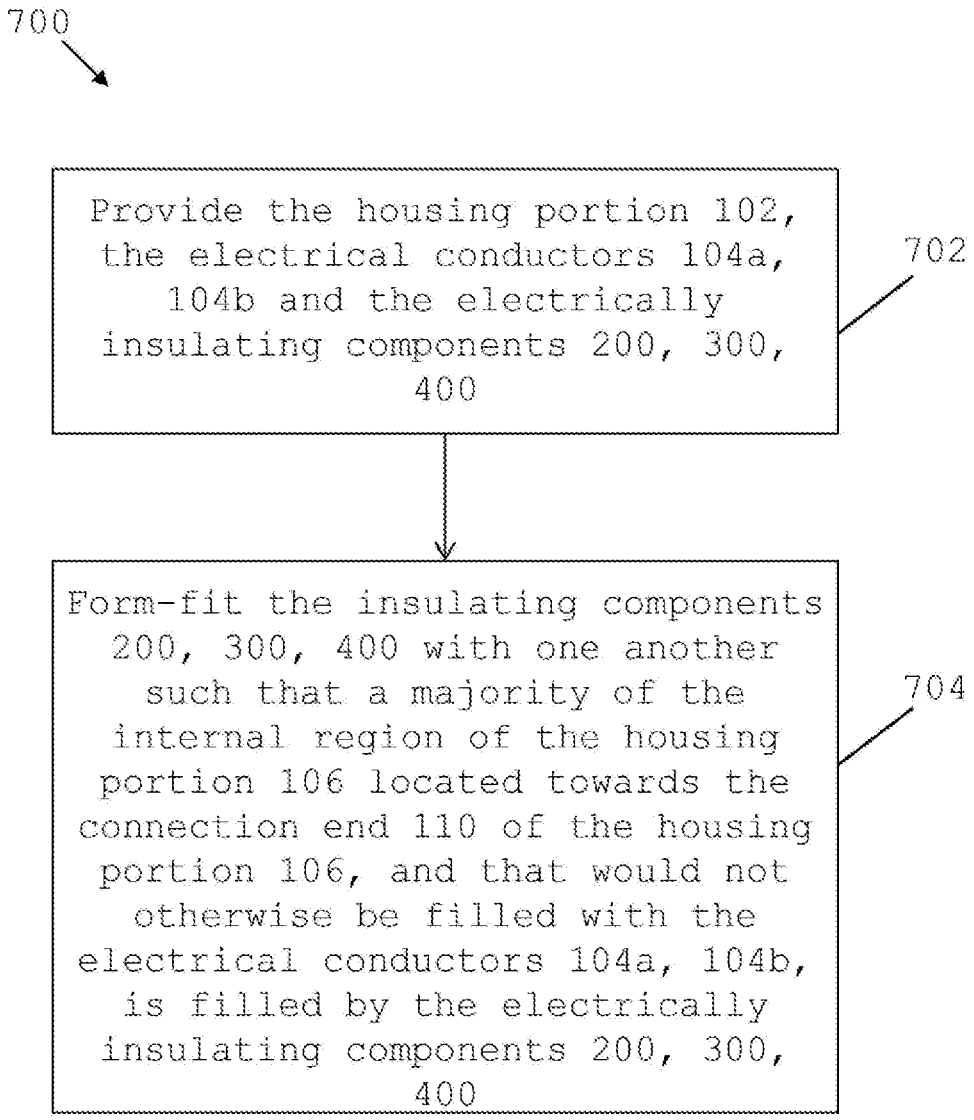
FIG. 7 is a flowchart of a method of forming the electrical connection component of FIG. 1.

FIG. 7 shows a flowchart of a method 700 of forming the electrical connection component 100. In a first step 702 of the method 700, the housing 106, the electrical conductors 104*a*, 104*b* and the electrically insulating components 200, 300, 400 are provided. In a second step 704, the insulating components 200, 300, 400 are form-fit with one another such that a majority of the internal region of the housing 106 that is located towards the connection end 110 of the housing 106, and that would not otherwise be filled with the electrical conductors 104*a*, 104*b*, is filled by the electrically insulating components 200, 300, 400.

It will be understood by persons skilled in the art of the invention that many modifications may be made without departing from the spirit and scope of the invention.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An electrical connection component for a machine cable, the electrical connection component being suitable for transmission of power with voltage levels greater than or equal to 1 kV, the electrical connection component comprising:

at least one electrical conductor being arranged for electrically coupling with a further electrical conductor of another electrical connection component;

a housing having an internal region, and having a machine cable end and a connection end; and at least two electrically insulating components positioned within the housing and each component being arranged to form-fit with an inner surface of the housing and with at least another component in a predefined orientation;

wherein a first component of the at least two electrically insulating components is positioned at a connection end of the housing, and a second component of the at least two electrically insulating components is positioned between the first component and the machine cable, wherein a portion of the internal region of the housing that is located at the connection end of the housing, and that would not otherwise be filled with the at least one electrical conductor and/or an associated flame path, is filled by the electrically insulating components, wherein at least one of the electrically insulating components comprises a passage for receiving a further electrically insulating component therewithin, and wherein at least a portion of the passage is shaped such that the further electrically insulating component fits within the passage in a predefined orientation about a longitudinal axis of the passage.

2. The electrical connection component of claim 1, wherein the electrically insulating components fill 10% or less, 20% or less, 30% or less, 40% or less, 50% or less, 60% or less, 70% or less, 80% or less, 90% or less, or 100% or less of the internal region of the housing measuring from the connection end that would not otherwise be filled with the at least one electrical conductor and/or an associated flame path.

3. The electrical connection component of claim 1, wherein the insulating components fills more than 70%, 80% or 90% of the internal volume of an internal portion of the housing.

4. The electrical connection component of claim 3, wherein the internal portion fills more than 90%, 80% 70%, 60%, 50% 40%, 30% or 20% of the internal volume of the housing.

5. The electrical connection component of claim 1, wherein the at least two electrically insulating components are arranged such that the at least one conductor penetrates through each of the electrically insulating components.

6. The electrical connection component of claim 1, wherein the first component has a protrusion having a particular shape, with the second component having a correspondingly shaped recess for receiving the protrusion of the first electrically shaped recess wherein, when the first component is received in the second component, the first and second insulating components have a predefined orientation with respect to one another.

7. The electrical connection component of claim 1, comprising an electrically insulating component that is arranged so as to receive a plurality of other electrically insulating components, wherein at least one of the electrically insulating components surrounds at least a portion of the at least one conductor, the at least one conductor penetrating therethrough.

8. The electrical connection component of claim 1, wherein the electrically insulating components comprise a polymeric material.

9. The electrical connection component of claim 1, wherein the first and second components are arranged to receive at least one third component through at least a portion of each of the first and second electrically insulating components.

10. The electrical connection component of claim 9, wherein the first and second electrically insulating components comprise respective passages that are aligned so as to receive the third electrically insulating component therethrough.

11. The electrical connection component of claim 9, wherein the respective passages of the first and second electrically insulating components, and the at least one third electrically insulating component, are arranged such that the at least one third electrically insulating component form-fits with the first and second electrically insulating components.

12. The electrical connection component of claim 9, wherein the at least one third component comprises a flange having a particular shape, the first or the second component comprising a recess having a shape corresponding to that of the flange of the third electrically insulating component such that the third electrically insulating component can only be arranged through the first and second electrically insulating components in one orientation.

13. The electrical connection component of claim 9, wherein the at least one third electrically insulating component comprises a tube that is arranged for receiving the at least one electrical conductor, the tube comprising a first material comprising an insulating material, the first material surrounding a length of the at least one electrical conductor that has been received by the tube, and a second material comprising a conductive material arranged to be electrically couplable to an earth of the machine cable, the second material surrounding the first material substantially along a length of the third component.

14. The electrical connection component of claim 9, wherein the first and second components are substantially cylindrically shaped.

15. A method of forming an electrical connection component, the electrical connection component being in accordance with claim 1, the method comprising the steps of:

providing the housing, the at least one electrical conductor, and the at least two electrically insulating components; and form-fitting at least one of the electrically insulating components with a further one of the electrically insulating components and with an inner surface of the housing in a predetermined orientation such that a portion of the internal region of the housing that is located at the connection end of the housing, and that would not otherwise be filled with the at least one electrical conductor and/or an associated flame path, is filled by the electrically insulating components.

* * * * *